US007581344B2

(12) United States Patent
Reynolds et al.

(10) Patent No.: US 7,581,344 B2
(45) Date of Patent: Sep. 1, 2009

(54) WEAPON EXTRACTOR AND CARTRIDGE

(75) Inventors: George L. Reynolds, Altona, IL (US); S. Paul Reynolds, Altona, IL (US)

(73) Assignee: Armalite, Inc., Geneseo, IL (US)

( * ) Notice: Subject to any disclaimer, the term of this patent is extended or adjusted under 35 U.S.C. 154(b) by 477 days.

(21) Appl. No.: 11/316,516

(22) Filed: Dec. 22, 2005

(65) Prior Publication Data

US 2006/0143966 A1 Jul. 6, 2006

Related U.S. Application Data

(60) Provisional application No. 60/638,482, filed on Dec. 22, 2004.

(51) Int. Cl.
*F41A 15/10* (2006.01)

(52) U.S. Cl. ..... 42/25; 102/470

(58) Field of Classification Search ..... 102/470; 42/25

See application file for complete search history.

(56) References Cited

U.S. PATENT DOCUMENTS

| | | | | |
|---|---|---|---|---|
| 27,933 | A | 4/1860 | Smith et al. | |
| 62,283 | A | 1/1867 | Millbank | |
| 102,675 | A | 5/1870 | Gatling | |
| 121,808 | A | 12/1871 | Payne | |
| 125,640 | A | 4/1872 | Wesson | |
| 172,716 | A | 1/1876 | Dimock | |
| 268,601 | A | 12/1882 | Bailey | |
| 592,942 | A | 11/1897 | Tichenor | |
| 692,154 | A | 1/1902 | Lammadin et al. | |
| 933,030 | A | 8/1909 | Funk | |
| 1,082,975 | A | 12/1913 | Rylands | |
| 1,345,565 | A | 7/1920 | Thompson | |
| 1,461,013 | A | 3/1923 | Hodge | |
| 1,491,000 | A | 4/1924 | Brandt et al. | |
| 2,379,056 | A | 6/1945 | Alexander | |
| 2,522,208 | A | 9/1950 | Catlin | |
| 2,793,455 | A | 5/1957 | Wignall | |
| 3,050,894 | A | 8/1962 | Ivy | |
| 3,062,146 | A * | 11/1962 | Williams et al. | 102/202.9 |
| 3,359,903 | A | 12/1967 | Sobolewski | |
| 3,477,374 | A | 11/1969 | Barr | |
| 3,609,904 | A | 10/1971 | Scanlon | |
| 3,613,584 | A | 10/1971 | Hendricks | |
| 3,631,622 | A * | 1/1972 | Walker et al. | 42/25 |
| 3,786,761 | A | 1/1974 | Ciccone et al. | |
| 3,855,900 | A | 12/1974 | Barr et al. | |
| 3,911,821 | A | 10/1975 | Finot et al. | |
| 4,085,677 | A | 4/1978 | Marcinkiewicz | |
| 4,132,173 | A | 1/1979 | Amuchastegut | |
| 4,316,341 | A | 2/1982 | Landry | |
| 4,353,304 | A | 10/1982 | Hubsch et al. | |
| 4,424,638 | A | 1/1984 | Hillberg | |

(Continued)

FOREIGN PATENT DOCUMENTS

| | | |
|---|---|---|
| AU | 403856 | 10/1969 |

(Continued)

*Primary Examiner*—Stephen M Johnson
(74) *Attorney, Agent, or Firm*—Krieg DeVault LLP

(57) ABSTRACT

A delayed action extractor for a blowback weapon operating system and a cartridge provided with a slideable primer and primer-supporting sleeve in a cartridge designed for use with the delayed action extractor.

18 Claims, 3 Drawing Sheets

U.S. PATENT DOCUMENTS 4,615,133 A 10/1986 Center
4,686,905 A * 8/1987 Szabo ..... 102/444
4,848,237 A 7/1989 Zedrosser
4,955,157 A 9/1990 Brighton et al.
5,157,219 A 10/1992 Calsson et al.
5,481,978 A 1/1996 Muller et al.
5,490,463 A 2/1996 Lamberty et al.
6,367,389 B1 4/2002 Westrom
6,516,725 B2 2/2003 Jackson et al.
6,564,719 B2 * 5/2003 Saxby ..... 102/446
2002/0189486 A1 12/2002 Westrom et al.

FOREIGN PATENT DOCUMENTS

DE 44 08 774 A1 3/1994
WO WO 01/46637 A2 6/2001

* cited by examiner

WEAPON EXTRACTOR AND CARTRIDGE

CROSS-REFERENCE TO RELATED APPLICATION

The present application claims the benefit of the filing date of Provisional application serial No. 60/638,482 filed on Dec. 22, 2004, which is incorporated herein by reference in its entirety.

BACKGROUND

Conventional self-powered machineguns firing high-pressure bottlenecked cartridges came into common use late in the $19^{th}$ century. The design of self powered machineguns and their bottlenecked cartridges have not essentially changed since their inception. Bottlenecked cartridges are required because cartridge cases must contain enough propellant to be able to provide adequate power without the cartridge cases being excessively long. Bottlenecked cartridges, by definition, are larger in diameter at the base than at the neck. The pressure area at the base of the cartridge is relatively larger than the basal area of the projectile being fired. This means there is more longitudinal force applied to the base of the cartridge than to the base of the projectile. Also, since the bodies of bottlenecked cartridge cases are larger than bore diameter, then more radial force is applied to the walls of the chamber than to any other part of the barrel. The largest diameter of the bottleneck cartridge, rather than the projectile diameter, dictates the design strength of the chamber and of the weapon locking system parts. The employment of bottlenecked cartridges results in weapon designs that are much larger and heavier than would be required than if cartridges were designed to be longer for a given propellant capacity, rather than larger in diameter.

Small diameter, high efficiency cartridges provided with conventional case heads cannot be employed in conventional small arms, however, because conventional cartridge case heads will not tolerate the higher pressures required for high efficiency conversion of propellant energy into projectile kinetic energy.

A gun, like an automobile engine, is a heat engine. The thermodynamic efficiency of converting the potential chemical energy of the propellant into kinetic energy in the projectile (other things also considered) is a function of the temperature drop across the heat engine process. Therefore the greater the temperature drop across the heat engine process the more efficient the process. Increased thermodynamic efficiency means less propellant (in a smaller cartridge case) is required to impart a given amount of kinetic energy to the projectile.

Pressure drop across the thermodynamic process equates directly to temperature drop (other things considered) as a measure of thermodynamic conversion efficiency. Therefore, the greater the operating pressure the weapon/cartridge system can tolerate, the higher the potential thermodynamic efficiency, and the smaller the required cartridge case for a given projectile weight and velocity. Smokeless powder, as used in conventional military small arms ammunition, is capable of generating about 230,000 pounds per square inch (psi). The highest normal operating pressures employed in conventional small arms weapons is 57,400 psi, or about 25% of the potential pressure of the propellant. The reason conventional cartridge cases cannot operate at higher pressure is that the rear of the cartridge case head, with its primer, must protrude from the rear of the barrel chamber in order to provide access for the weapon extractor to the extraction groove of the cartridge case. The primer is fully pressurized by the propellant gases, and while the bolt face fully supports the longitudinal pressure exerted against the base of the primer, the sole support for the radial pressure within the primer is provided by the strength of the cartridge case head itself. This means the operating pressure limit in a conventional cartridge is determined by the strength of the cartridge case itself, irrespective of the strength of the weapon.

One grain weight of the double base propellant used in the 5.56 mm NATO Cartridge employed by the U.S. Military contains about 215.15 ft/lbs. of chemical energy. The propellant charge for the 5.56 mm cartridge is about 27.0 grains. The potential energy of the propellant in this cartridge is therefore 215.15×27.0=5,809.05 ft/lbs. The muzzle velocity of a 62 grain projectile fired from a 5.56 mm cartridge is about 3,050 ft/sec, yielding a muzzle energy of about 1,280 ft/lbs. The thermodynamic conversion efficiency is therefore 5,809.05/1,280=0.2203, or about 22%.

Conventional, high pressure, full power machineguns are provided with some means for locking the cartridge within the weapon barrel chamber during firing. The locking system is typically composed of complex and tightly toleranced parts. The locking system parts interact with each other during firing to sequentially perform the steps in the operating cycle. Locking, firing, extraction and ejection functions are typically concentrated in a small volume at the front of the bolt, which means the functions and the parts involved compete for space.

In conventional weapon and cartridge design there is usually a gap between the face of the fully locked weapon bolt and the rear of the cartridge. This gap is not desirable, but is the result of weapon and ammunition manufacturing tolerances, as well as weapon wear. This gap results in what is called "headspace." This actual headspace must be accounted for in the design of the weapon and its ammunition, even though ideally there would be zero headspace. Zero headspace would place the cartridge in intimate contact with the face of the bolt for firing. Even with zero headspace there is always some elastic deformation of the weapon locking system parts permitting some elastic movement of the cartridge case head during firing.

When a high pressure cartridge is fired, the firing pressure forces the cartridge case wall against the wall of the chamber, and at the same time the firing pressure also drives the head of the cartridge rearward. The cartridge case wall adjacent to the cartridge case head stretches elastically and then plastically rearward while the body of the case is seized within the chamber. If there is excessive headspace, the cartridge case wall adjacent to the cartridge case head will stretch plastically until the cartridge case head is weakened. At some point, this plastic stretching can result in separation of the cartridge case head from the case body, resulting at worst, in the release of large amounts of high pressure gas into the weapon breach, blowing up the weapon.

The employment of conventional high-pressure bottleneck cartridges in conventional small arms weapons has resulted in relatively heavy, inefficient and expensive machineguns and ammunition.

SUMMARY

The cartridge of the present invention is capable of sustaining much higher operating pressures than conventional cartridge cases because all the radial pressure generated within the cartridge is supported by the weapon barrel rather than by the cartridge case itself. This is accomplished by moving the primer forward within the base of the cartridge case and placing a cylindrical primer-supporting sleeve between the primer and the base of the cartridge case. This places the primer entirely within the rear of the chamber of the barrel. The rear of the primer-supporting sleeve is located flush with the base of the cartridge case. The long axis of the cylindrical primer-supporting sleeve is coincident with the long axis of the cartridge case.

The cartridge case and primer-supporting sleeve are designed so that longitudinal firing pressure within the primer is fully supported longitudinally by the primer-supporting sleeve, and that the radial pressure within the primer is transmitted through the cartridge case wall to the barrel of the weapon. In this way, all of the firing pressure is transmitted to the weapon rather than relying solely on the strength of the rear of the cartridge case head to support firing pressure.

The primer-supporting sleeve is provided with a central hole on its longitudinal axis that provides access for the weapon firing pin to reach the primer. The primer and primer-supporting sleeve are provided with a friction fit with their cylindrical pocket in the body of the cartridge case. The friction fit is designed so that under firing pressure, the primer and primer-supporting sleeve are slideably extendable relative to their cylindrical pocket in the cartridge case body during firing. After the cartridge has been fired, and with the primer-supporting sleeve extended, the primer-supporting sleeve is retained by the friction fit with the base of the cartridge case.

The weapon is not provided with a locked bolt. When the weapon is fired the pressure within the cartridge rises rapidly, elastically expanding the cartridge case against the chamber wall, temporarily seizing the cartridge case body within the chamber. The primer and the primer-supporting sleeve are driven slideably rearward by weapon firing pressure within their cavity in the base of the cartridge case while the cartridge case is temporarily tightly seized by firing pressure within the weapon barrel chamber. The primer-supporting sleeve drives the unlocked bolt rearward with a velocity determined by the ratio of M(1)V(1)=(r) M(2)V(2), where:

M(1) represents the mass of the projectile;
V(1) represents the velocity of the projectile;
M(2) represents the mass of the bolt;
V(2) represents the velocity of the bolt; and
(r) is the ratio of the basal area of the projectile divided by the area of the pressure area of the primer.

Given:
M(1)=projectile weight; 62 grains/7000=0.0088571 lbs
V(1)=projectile muzzle velocity; 3,050 feet per second
M(2)=a reasonable bolt mass=1.54 lbs (the recoiling parts of an M249 light machinegun weigh 1.63 lbs. by comparison)
V(2)=a reasonable initial bolt velocity=20 ft/sec
(r)=ratio of area of 0.210 diameter primer/area of 0.224 diameter projectile=0.034636/0.0394081=0.8789

Substituting Values:
M(1) V(1)=M(2) V(2) (r) then:
(0.0088571)(3,050)=(1.54) (20)(0.8789)

From the above it can be seen that a simple blowback operating system with a relatively light-weight bolt (1.54 lbs. at 20 ft/sec) can be employed with the invention cartridge firing the same projectile (62 grains) and providing exactly equal to the muzzle velocity (3,050 ft/sec) as 5.56 mm NATO Ammunition.

In order to employ a cartridge having a primer-supporting sleeve in a blowback operated weapon, the cartridge case must be permitted to remain stationary within the chamber as long as the cartridge is pressurized above the elastic strength of the cartridge case. While propellant pressure drives the primer, the primer-supporting sleeve, and the bolt rearward, the cartridge case body remains seized by friction in the chamber until the chamber pressure drops sufficiently for the cartridge case body to elastically contract and free itself from the chamber.

The bolt is provided with an extractor that is mounted so that the extractor can slideably, longitudinally, reciprocate relative with the bolt. The extractor can extend longitudinally forward as the bolt moves rearward while the extractor is engaged with the extraction rim. The extractor is engaged with the extraction rim of the cartridge so the extractor remains motionless relative to the cartridge case that is seized in the chamber for as long as the propellant pressure in the chamber remains high and while the pressurized gas in the chamber drives the primer and primer supporting sleeve rearward. The bolt mass is designed such that the pressure in the chamber drops sufficiently to permit the cartridge case to elastically relax away from the chamber wall before the extractor is picked up by the bolt. After this point the bolt picks up the extractor with its cartridge case. The extractor is spring loaded to bias the extractor toward the rear.

The extractor and bolt are designed so that when the cartridge is positioned on the face of the bolt, the cartridge is pressed against the face of the bolt by the rearwardly spring-biased extractor. This feature is provided so there will be no gap (zero headspace) between the rear of the cartridge and the face of the bolt.

In order to employ the invention cartridge case and blowback operation, the inside diameter of the cartridge case needs to be approximately the same as that of the primer, which results in eliminating the effective pressure area which can stretch the cartridge case head rearward. The moveable portions of the cartridge case consist of the slideably moveable primer and the primer-supporting sleeve that permit the cartridge case body to remain seized and stationary within the barrel chamber while firing pressure remains high and the primer and primer-supporting sleeve move slideably rearward, driving the blowback operated bolt rearward. The spring loaded extractor remains engaged with the extraction rim of the cartridge while the bolt is initially being driven rearward. When chamber pressure subsides sufficiently to permit the empty cartridge to be extracted, the blowback operated bolt, which is moving rearward, picks up the extractor causing the empty cartridge case to be extracted from the chamber.

DETAILED DESCRIPTION OF ILLUSTRATIVE EMBODIMENT

Figure 1:
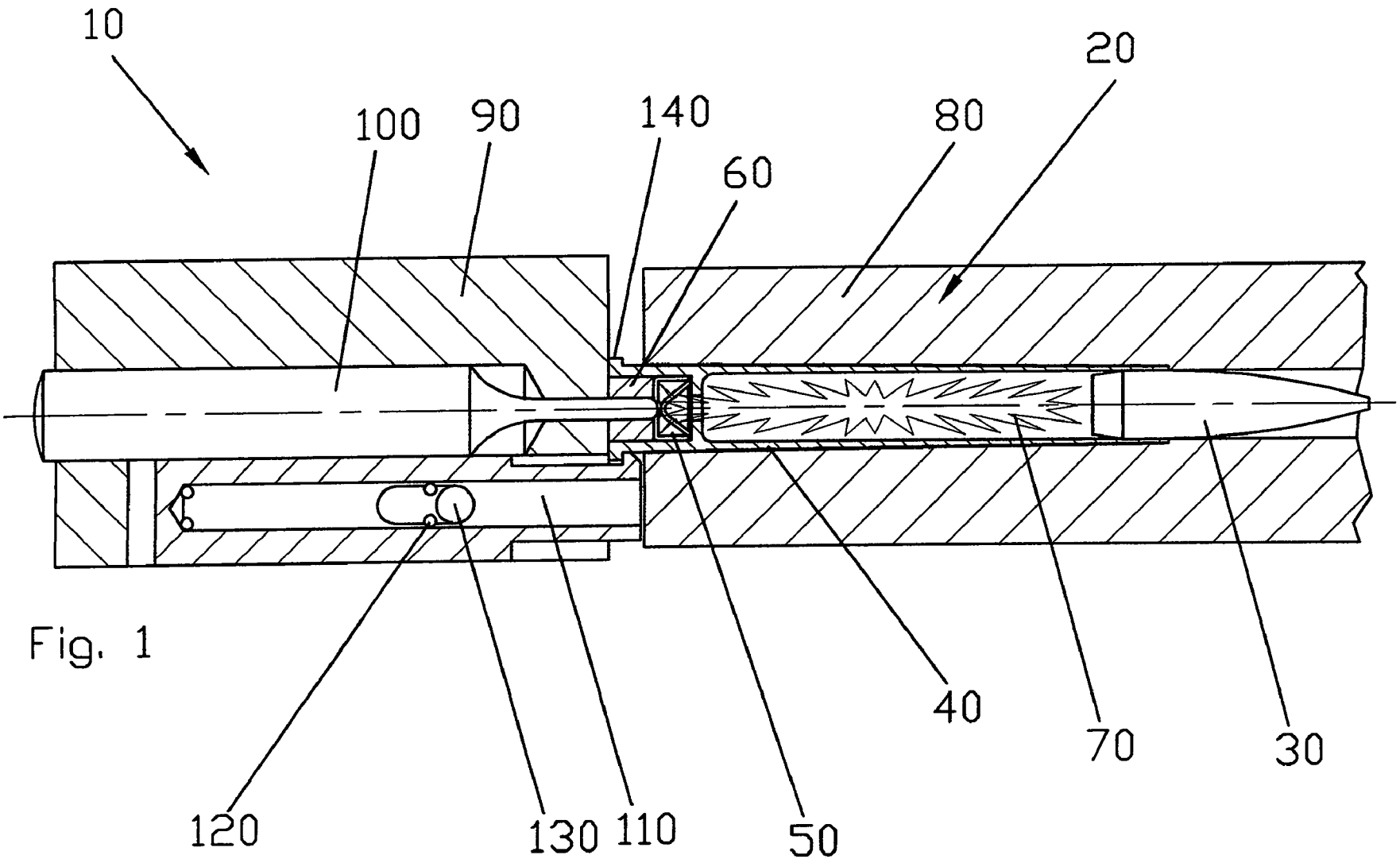
FIG. 1 is a sectional side view of the weapon and cartridge at the moment of firing, but before the projectile, primer, primer-supporting sleeve or bolt have begun to move.

Referring now to FIG. 1 which is a sectional side view of selected portions of the weapon mechanism 10 and cartridge 20 at the moment of firing and before the projectile 30, primer 50, primer-supporting sleeve 60 and bolt 90 have started to move. Firing pin 100 has impacted primer 50, initiating primer 50 and igniting the propellant that is generating propellant gas 70. Propellant gas 70 is applying pressure against the base of projectile 30; against the inside of cartridge case 40; and against the interior surfaces of primer 50. Longitudinal firing pressure is being transmitted through primer 50 to primer-supporting sleeve 60, and through primer-supporting sleeve 60 to the face of bolt 90.

Bolt 90 is not locked against the base of cartridge 20, but weapon mechanism 10 is blowback operated which means that only the mass of bolt 90 is providing longitudinal support for the rear of primer supporting sleeve 60 and cartridge case 40. Extractor 110 is engaged with the extraction rim 140 of cartridge case 40. Extractor spring 120 is applying pressure to bias extractor 110 rearwardly against extraction rim 140 of cartridge case 40 to draw the base of cartridge case 40 against the bolt face resulting in zero headspace during firing. Extractor spring pin 130 secured in bolt 90 provides an anchor point for extractor spring 120 to react against in bolt 90. As bolt 90 moves rearwardly, extractor 110 remains stationary relative to extraction rim 140 of cartridge case 40.

Figure 2:
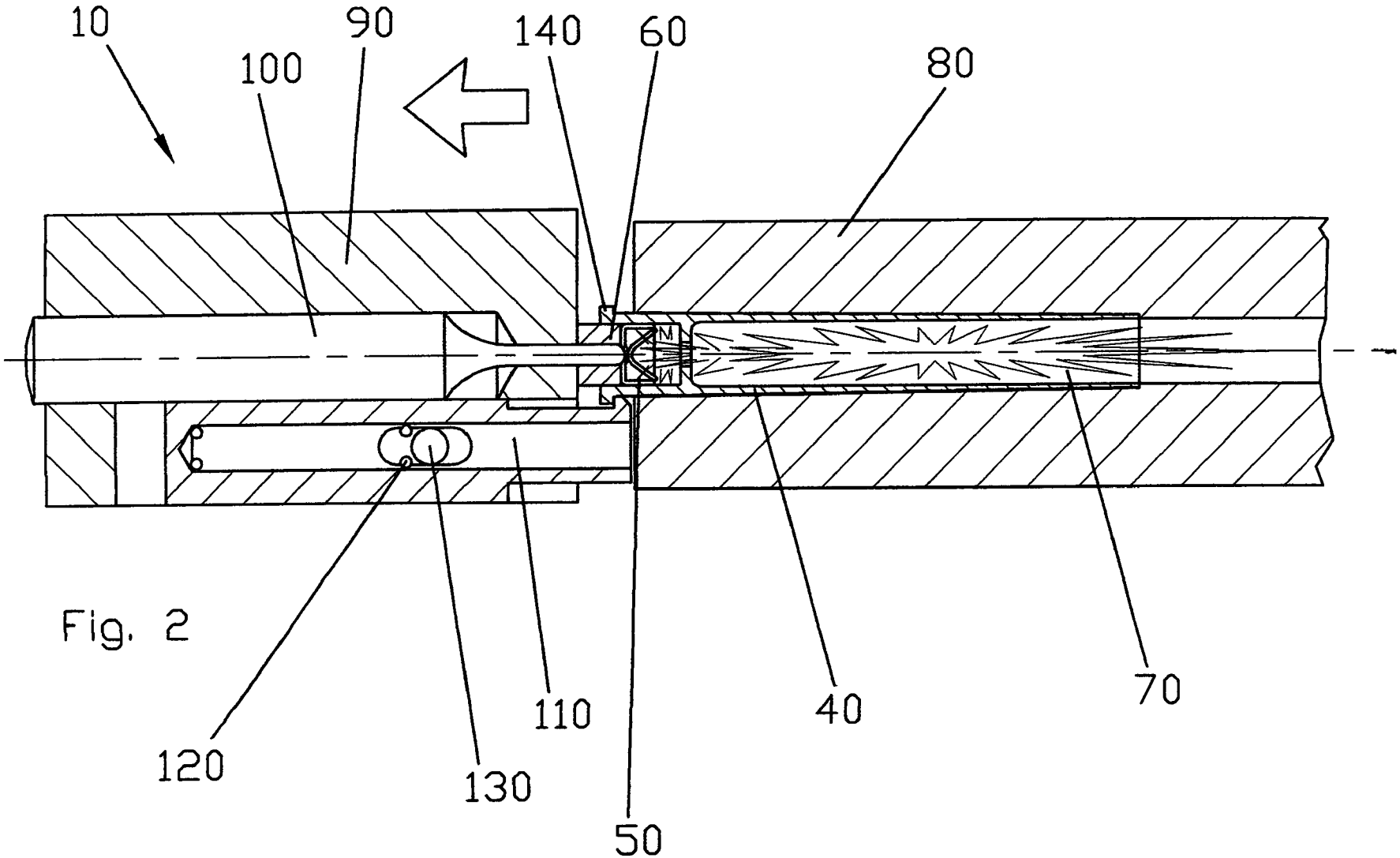
FIG. 2 is a sectional side view of the weapon and cartridge during firing with firing pressure seizing the cartridge case within the chamber. The bolt is being driven rearward by the primer-supporting sleeve, which is being driven by the primer, which in turn, is being driven by firing pressure.

Referring now to FIG. 2, which is a sectional side view of selected portions of weapon mechanism 10 and cartridge-case 40 during firing. The longitudinal axis of cylindrical primer-supporting sleeve 60 is coincident with the longitudinal axis of cartridge case 40. Cylindrical primer supporting sleeve 60 is slideably located within the rear of cartridge case 40 of cartridge 20. The outer radial surface of primer 50 can be provided with lubricant which will permit internally pressurized primer 50 to move rearward while under firing pressure. The projectile (not shown) is being driven through the bore by pressure applied by propellant gas 70. Pressure in propellant gas 70 continues to press the wall of cartridge case 40 against the chamber of barrel 80, seizing by friction, the body of cartridge case 40 within the chamber of barrel 80 while the pressure of propellant gas 70 also drives primer 50, along with primer-supporting sleeve 60 and bolt 90 rearwardly. Therefore cartridge case 40 remains stationary within the chamber during firing the same way as the cartridge case remains stationary within the chamber of a conventionally locked weapon mechanism during firing. The utilization of a primer having the same pressure area as the inside diameter of the cartridge case eliminates the area on which the longitudinal component of propellant gas force can operate. In conventional bottlenecked cartridges this longitudinal pressure component is the force that stretches conventional cartridge case heads rearward during firing. Primer 50 and primer-supporting sleeve 60 are moving slideably rearwardly; driving bolt 90 rearwardly, operating the weapon by conventional blowback operation. Utilizing moveable primer 50 with moveable primer-supporting sleeve 60 in the invention cartridge case enables realizing the advantages of employing very simple blowback operation for machineguns and rifles which conventionally require complex locked operating systems.

The invention cartridge case is different from cartridges designed for piston primer actuated weapons in that piston primer actuated weapons employ locked bolts. If piston primer actuation were employed in unlocked weapons, then the use of the invention rearwardly biased, spring loaded extractor would be required. The rearwardly biased extractor results in each cartridge being fired with zero headspace which eliminates stretching of the cartridge case wall ahead of the cartridge case head.

While bolt 90 is moving rearwardly, with cartridge case 40 remaining seized by friction in the chamber, extractor 110 also remains stationary relative to cartridge case 40 because extractor 110 is engaged with extraction rim 140 of cartridge case 40 of cartridge 20. Extractor spring 120 is being compressed between extractor 110 and extractor spring pin 130 of bolt 90 as bolt 90 moves rearwardly relative to extraction rim 140. When the pressure of propellant gas 70 drops sufficiently to permit cartridge case 40 to elastically contract away from the chamber wall of barrel 80, cartridge case 40 is released from the chamber of barrel 80, permitting extractor 110 to withdraw cartridge case 40 from the chamber.

Figure 3:
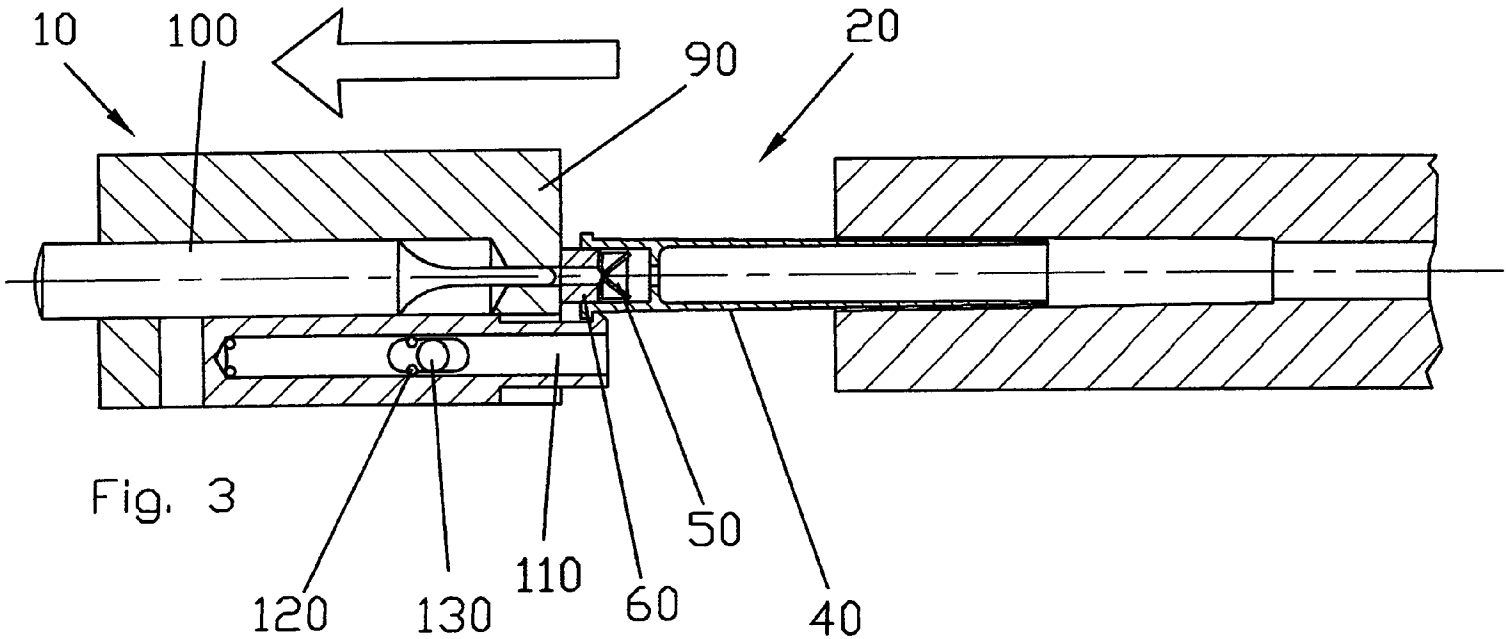
FIG. 3 is a sectional side view of the weapon and cartridge after pressure in the chamber has dropped sufficiently to permit the cartridge to be extracted from the chamber.

Referring now to FIG. 3, which is a sectional side view of selected portions of weapon mechanism 10 and cartridge case 40 during extraction. Extractor 110 is extracting cartridge case 40 from the chamber of barrel 80. Firing pin 100 has been moved sufficiently rearward to permit cartridge case 40 to be pivoted out of engagement with extractor 110 after cartridge case 40 has been extracted sufficiently from the chamber of barrel 80 to permit ejection.

Figure 4:
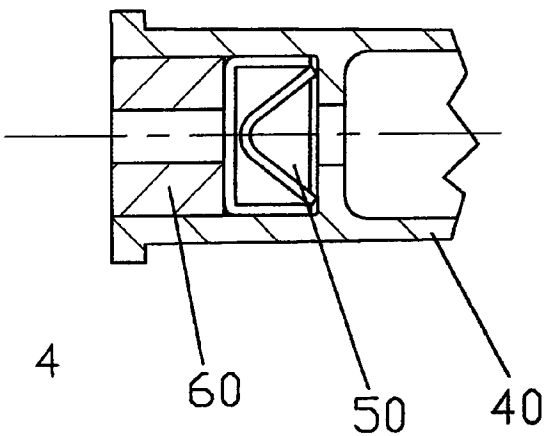
FIG. 4 is a partial sectional side view of the rear of the cartridge case before firing.

Referring now to FIG. 4, which is a sectional view of the rear portion of cartridge case 40 with primer 50 and primer-supporting sleeve 60. Primer 50 and primer-supporting sleeve 60 are fitted to cartridge case 40 with a light press fit of the type typically used with primers seated in conventional cartridges. The outside annular surface of primer 50, where it makes contact with cartridge case 40, may be provided with lubricant that will permit primer 50 to move slideably rearward under firing pressure. Primer-supporting sleeve 60 is designed to move slideably rearward when primer 50 is driven rearwardly through the action of pressurized propellant gasses.

Figure 5:
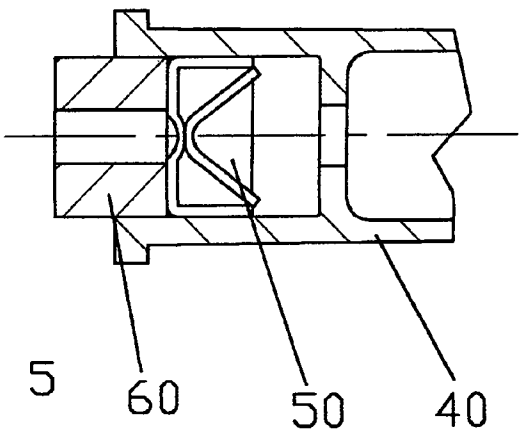
FIG. 5 is a partial sectional side view of the rear of the cartridge case after firing.

Referring now to FIG. 5 which is the same as FIG. 4 except the cartridge has been fired and primer 50 and primer supporting sleeve 60 have been driven rearwardly through firing of the cartridge. Primer-supporting sleeve 60 is protruding from the rear of cartridge case 40. Primer-supporting sleeve 60 and primer 50, which are provided with a light press fit with cartridge case 40 are retained in cartridge case 40 by that light press fit.

What is claimed is:

1. A weapon system, comprising:

a firearm having a barrel defining a bore extending from a rearward end toward a forward end, wherein said firearm includes a bolt having a forward face adjacent said rearward end of said barrel, said firearm further including an extractor;

a cartridge in said bore of said barrel adjacent said rearward end of said barrel, said cartridge including:

a case for containing a propellant, said case further defining a pocket extending forwardly from a rearward end of said case to an end adjacent said propellant;

a projectile at a forward end of said case;

a primer-supporting member in said pocket adjacent said rearward end of said case; and a primer in said pocket between said primer-supporting member and said propellant, wherein said primer is positioned entirely forwardly of said rearward end of said barrel;

wherein said extractor is engaged to a rim of said cartridge at said rearward end of said case and said extractor is reciprocal relative to said bolt such that when said bolt recoils upon firing of said cartridge said extractor remains motionless relative to said case while said primer and said primer-supporting member drive said bolt rearward until said bolt engages said extractor to displace said extractor rearwardly and withdraw said case from said bore in said barrel.

2. The system of claim 1, wherein said primer-supporting member is a sleeve extending along a longitudinal axis, said longitudinal axis of said sleeve being coincident with a longitudinal axis of said case.

3. The system of claim 2, wherein said sleeve includes a central hole extending along said longitudinal axis thereof.

4. The system of claim 1, wherein said firearm includes a firing pin and said firing pin is configured to pass through said hole to said primer in said pocket of said case.

5. The system of claim 1, wherein said primer-supporting member and said primer are frictionally engaged with said case in pocket.

6. The system of claim 1, wherein said extractor is spring-biased rearwardly to bias a rearward end of said case into contact with said forward face of said bolt.

7. The system of claim 1, wherein said case defines an internal diameter for containing said propellant and said primer includes a diameter that is approximately the same as said internal diameter.

8. The system of claim 1, wherein said primer is in communication with said propellant through said end of said case adjacent said propellant.

9. The system of claim 1, wherein said primer and said primer-supporting member are supported in said case with said primer supporting member flush with said rearward end of said case, said primer and primer-supporting member are structured to slide rearwardly in said pocket during firing of said cartridge.

10. The system of claim 1, wherein an outer surface of said primer includes lubricant.

11. A weapon system, comprising:

a firearm having a barrel defining a bore extending from a rearward end toward a forward end, wherein said firearm includes a bolt having a forward face adjacent said rearward end of said barrel, said firearm further including an extractor;

a case for containing a propellant, said case further defining a pocket extending from a rearward end of said case to an end between said pocket and said propellant;

a projectile at said forward end of said case;

a primer-supporting sleeve fitted within said pocket at said rearward end of said case; and a primer fitted within said pocket between said primer-supporting sleeve and said propellant, wherein said primer and said primer-supporting sleeve are rearwardly movable in said pocket in response to firing of said projectile;

wherein said extractor is engaged to a rim of said cartridge at said rearward end of said case and said extractor is reciprocal relative to said bolt such that when said bolt recoils upon firing of said cartridge said extractor remains motionless relative to said case while said primer and said primer-supporting member drive said bolt rearward until said bolt engages said extractor to displace said extractor rearwardly and withdraw said case from said bore in said barrel.

12. The cartridge of claim 11, wherein said primer-supporting sleeve extends along a longitudinal axis, said longitudinal axis of said sleeve being coincident with a longitudinal axis of said case.

13. The cartridge of claim 12, wherein said sleeve includes a central hole extending along said longitudinal axis thereof for receiving a firing pin.

14. The cartridge of claim 11, wherein said primer-supporting sleeve and said primer are frictionally engaged with said case in said pocket.

15. The cartridge of claim 11, wherein said case defines an internal diameter for containing said propellant and said primer includes a diameter that is approximately the same as said internal diameter.

16. The cartridge of claim 11, wherein said primer is in communication with said propellant through said end of said case adjacent said propellant.

17. The cartridge of claim 11, wherein an outer surface of said primer includes lubricant.

18. The system of claim 11, wherein said extractor is spring-biased rearwardly to bias a rearward end of said case into contact with said forward face of said bolt.

* * * * *